US006205916B1

(12) United States Patent
Castleton

(10) Patent No.: US 6,205,916 B1
(45) Date of Patent: Mar. 27, 2001

(54) METHOD OF OPERATING A STAMPING PRESS

(75) Inventor: Michael Adrian Castleton, Suffolk (GB)

(73) Assignee: Blackfoil Group Limited, Suffolk (GB)

( * ) Notice: Subject to any disclaimer, the term of this patent is extended or adjusted under 35 U.S.C. 154(b) by 0 days.

(21) Appl. No.: 09/284,492

(22) PCT Filed: Oct. 8, 1997

(86) PCT No.: PCT/IB97/01247

§ 371 Date: Apr. 12, 1999

§ 102(e) Date: Apr. 12, 1999

(87) PCT Pub. No.: WO98/16370

PCT Pub. Date: Apr. 23, 1998

(30) Foreign Application Priority Data

Oct. 11, 1996 (GB) ..... 9621272

(51) Int. Cl.[7] ..... B30B 13/00; B30B 15/16; B30B 1/32

(52) U.S. Cl. ..... 100/35; 100/48; 100/269.14

(58) Field of Search ..... 100/38, 269 R, 100/35, 315, 317, 215, 233, 265, 266, 269.01, 270, 269.05, 269.06, 269.14, 274, 48; 60/413

(56) References Cited

U.S. PATENT DOCUMENTS

| | | | |
|---|---|---|---|
| 2,614,539 | | 10/1952 | Ernst . |
| 4,151,718 | | 5/1979 | Gravely, Sr. . |
| 4,264,394 | | 4/1981 | Izumihara . |
| 4,707,988 | * | 11/1987 | Palmers ..... 60/413 |
| 5,134,931 | | 8/1992 | Thompson et al. . |
| 5,158,723 | * | 10/1992 | Walchhutter et al. ..... 100/269 R |
| 5,325,668 | * | 7/1994 | Walchhutter et al. ..... 60/413 |
| 5,526,738 | | 6/1996 | Logan . |

FOREIGN PATENT DOCUMENTS

| | | |
|---|---|---|
| 1627843 | 10/1970 | (DE) . |
| 2022812 | 11/1971 | (DE) . |
| 2349351 | 4/1975 | (DE) . |
| 3017406 | 11/1981 | (DE) . |
| 0116024 | 8/1984 | (EP) . |
| 0594217 | 4/1994 | (EP) . |
| 908380 | 10/1962 | (GB) . |
| 1208272 | 10/1970 | (GB) . |
| 1592369 | 7/1981 | (GB) . |
| 9209424 | 6/1992 | (WO) . |
| 9504657 | 2/1995 | (WO) . |

* cited by examiner

*Primary Examiner*—Peter Vo
*Assistant Examiner*—Louis K. Huynh
(74) *Attorney, Agent, or Firm*—Bourque & Associates, PA

(57) ABSTRACT

A stamping press has a pair of plates defining a press gap between them, a hydraulic ram to produce relative movement between the plates to close the press gap and apply pressure to the die against a substrate in the gap, a hydraulic pump driven by an electric motor through a flywheel means for shutting off the motor on reaching a predetermined pressure in the circuit, and a dump valve for dumping hydraulic pressure from the circuit.

5 Claims, 2 Drawing Sheets

METHOD OF OPERATING A STAMPING PRESS

FIELD OF THE INVENTION

This invention relates to a stamping press, preferably a desk-top stamping press. The press can be used for a variety of stamping functions, among which are embossing a substrate, applying a foil to a substrate or applying foil and an emboss to a substrate. The invention is particularly, but not exclusively, useful for applying security markings to documents.

BACKGROUND OF THE INVENTION

Foil embossing machines are conventionally substantial pieces of equipment located in a factory or printing shop environment. However there is a need, particularly for the preparation of important documents such as passports and cheques, for the security features to be applied locally and on a one-off basis to a document. This need could be satisfied by a desk-top foil embossing machine, and it is therefore an object of this invention to provide a stamping press which can be used on an intermittent basis, from a desk-top location in an office environment.

SUMMARY OF THE INVENTION

According to a first aspect of the invention, there is provided a method of operating a stamping press which has a pair of plates defining a press gap between them, and an hydraulic ram to produce relative movement between the plates to close the press gap and apply pressure to the die to press the die against a substrate in the gap, wherein the hydraulic ram is fed with hydraulic fluid from a pump driven by an electric motor, the method comprising the steps of driving the motor to pressurize the hydraulic system to a pressure below the maximum pressure to be achieved, shutting off electric current to the motor and allowing the motor to continue to run under its own inertia until it stalls, to pressurize the hydraulic system to a higher pressure, and opening a valve to dump the pressure after a predetermined time period.

The motor may be shut off in response to the attainment of a specific predetermined pressure in the system, eg in response to a signal from a pressure sensor, or it may be shut off after a specified time which has been predetermined as corresponding to a desired pressure in the hydraulic system. As an alternative to the use of a conventional pressure sensor, electric current drawn by the motor may be measured. A rise in current corresponds to attainment of a particular pressure.

The press may be operated so that when the pressure in the hydraulic system reaches the predetermined low pressure, a first timer is started and after a pre-set time period electric current to the motor is switched off. A second timer can be used to determine when the dump valve is opened to dump the pressure.

The motor may have a flywheel and the size of the flywheel will then be determined in accordance with the maximum pressure to be achieved. Alternatively, the mass of the motor rotor may provide sufficient inertia for a separate flywheel to be unnecessary.

The invention further provides a stamping press which has a pair of plates defining a press gap between them, an hydraulic ram to produce relative movement between the plates to close the press gap and apply pressure to the die to press the die against a substrate in the gap, a hydraulic pump driven by an electric motor through a flywheel, means for shutting off the motor on reaching a predetermined pressure in the circuit, and a dump valve for dumping hydraulic pressure from the circuit.

The press is preferably adapted to be placed on a table for operation. The press may have a manual feed by which an operator can feed single substrates into the press. In some embodiments, where continuous stationary is to be embossed, a conventional tractor feed can be used to feed substrate through the press.

The press preferably is powered by an electricity supply available in an office environment, and preferably the power consumption of the press is less than 1500 W. This is well within the limits of standard office power supplies.

A typical press-in accordance with the invention has a motor rated at 150 watts, with a heater rated at 350 watts.

One of the plates is preferably fixed and the other is movable to close the press gap. The gap will normally be horizontal, and either the upper or the lower plate can be the movable plate.

The hydraulic pump and the electric motor can be housed in a reservoir of hydraulic fluid, so that the fluid acts as a coolant for the motor. A fan can be provided to cool the exterior of the reservoir, to extract heat from the fluid therein.

Using such a press makes it possible to apply the extremely high pressures required for embossing fine foiled patterns on substrates. For example, a press with a 150 watt motor can apply a total load of up to 10 tons. Hot stamping dies require a pressure of 2–3 tons/in$^2$, so the pressure attainable by this press, with its small overall size, is quite suitable for such purposes. In the case of applying a foil without any embossing, lower pressures are required, and the press can apply foil to a complete A5 sheet in one pass, and thus a complete A4 sheet in only two repeat impressions.

According to a second aspect of the invention, there is provided a stamping press having a pair of plates defining a press gap between them, at least one of the plates being adapted to carry a stamping die, a foil feed and take off arrangement adapted to feed foil to one side of the gap and to draw foil off from the other side of the gap, and an hydraulic ram to produce relative movement between the plates to close the press gap and apply pressure to the die to press the die against the foil and the foil against a substrate in the gap, wherein the foil feed and take off rollers are mounted above the ram and the foil is fed from the take-off roller, substantially parallel to the ram actuation direction towards the gap, and from the gap again in a direction substantially parallel to the ram actuation direction to a take up roller.

The stamping die can, for example, be a foiling die, an embossing die or a foil/emboss die.

By thus locating the ram inside the foil path, a machine with a very small footprint can be achieved, making the machine suitable for desk-top use.

The stamping die can preferably be removed and replaced from one side of the press, without dismantling other components. The die can be mounted on a plate which slides in guide tracks on one of the press plates, and a locking mechanism can be provided to secure the die plate in position.

The foil feed and take off arrangement is preferably mounted wholly within the area of the press platen projected in a direction parallel to the axis of the ram.

The hydraulic ram is preferably included in a hydraulic circuit comprising a pump, a pressure sensor and a fluid reservoir, wherein the pump is driven by an electric motor through a flywheel.

One of the press plates preferably moves with the hydraulic ram and the other is non-moving. The fluid reservoir may be incorporated in the non-moving plate of the press.

According to a third aspect of the invention, there is provided a foil feed arrangement in a foiling press, the arrangement comprising an undriven set of rollers on the upstream side of the press and a driven set of rollers on the downstream side, the driven set comprising a relatively small diameter roller and a relatively large diameter roller, the two rollers being mounted parallel and in contact with one another to define a foil nip, a motor arranged to drive the smaller of the rollers, foil guide surfaces arranged to feed foil from the press around at least 180° of arc on the larger roller, into the nip and around the smaller roller to a take-up reel.

The drive motor is preferably a stepper motor or a synchronous motor with the drive motor spindle mounted on the axis of the smaller roller, to give a direct drive. The smaller diameter roller can have a friction-enhancing surface.

BRIEF DESCRIPTION OF THE DRAWINGS

The invention will now be further described, by way of example, with reference to the accompanying drawings, in which.

DETAILED DESCRIPTION OF THE PREFERRED EMBODIMENT

Figure 1:
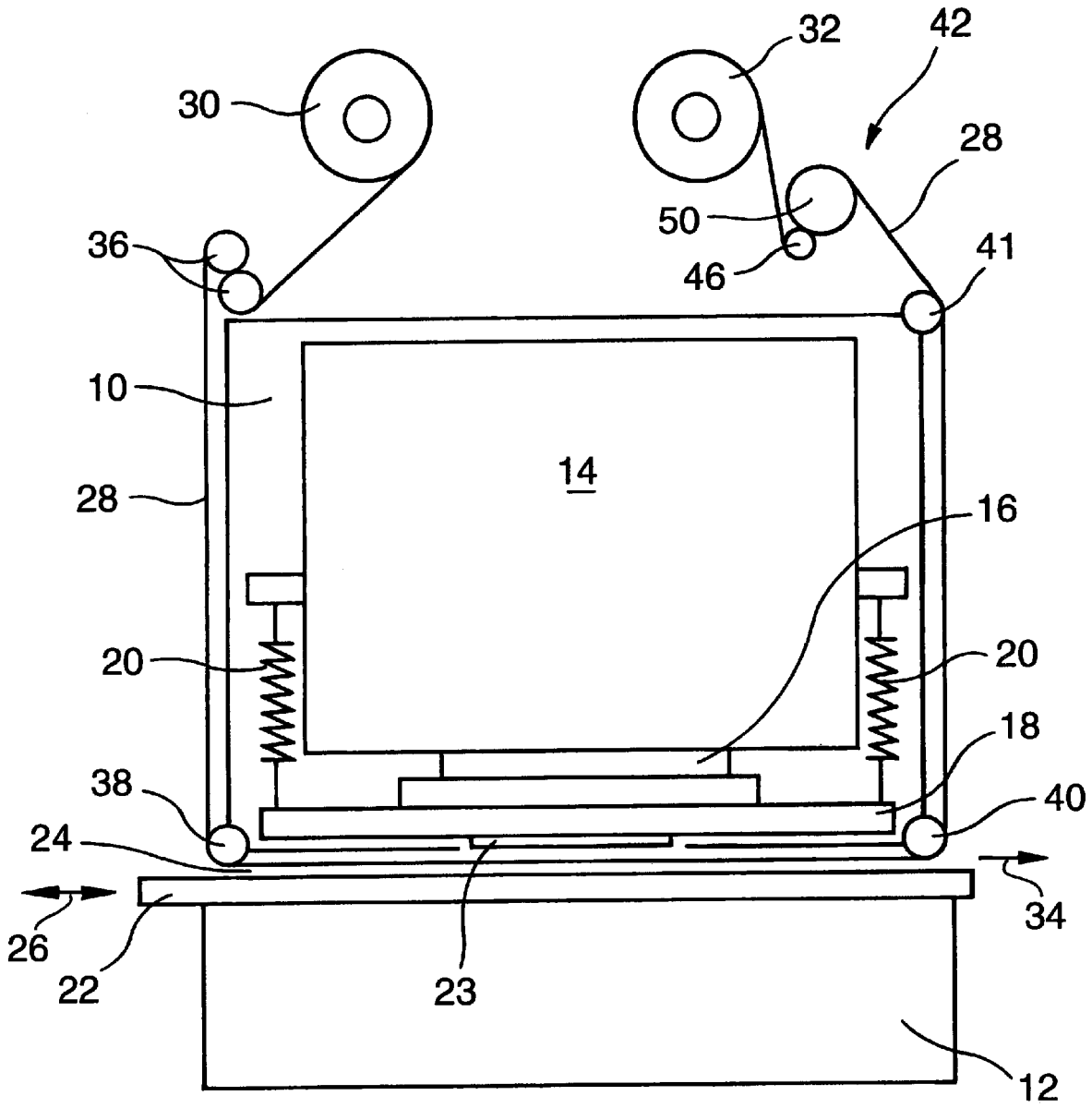
FIG. 1 is a diagrammatic drawing of a foil embossing machine in accordance with the invention.
Figure 2:
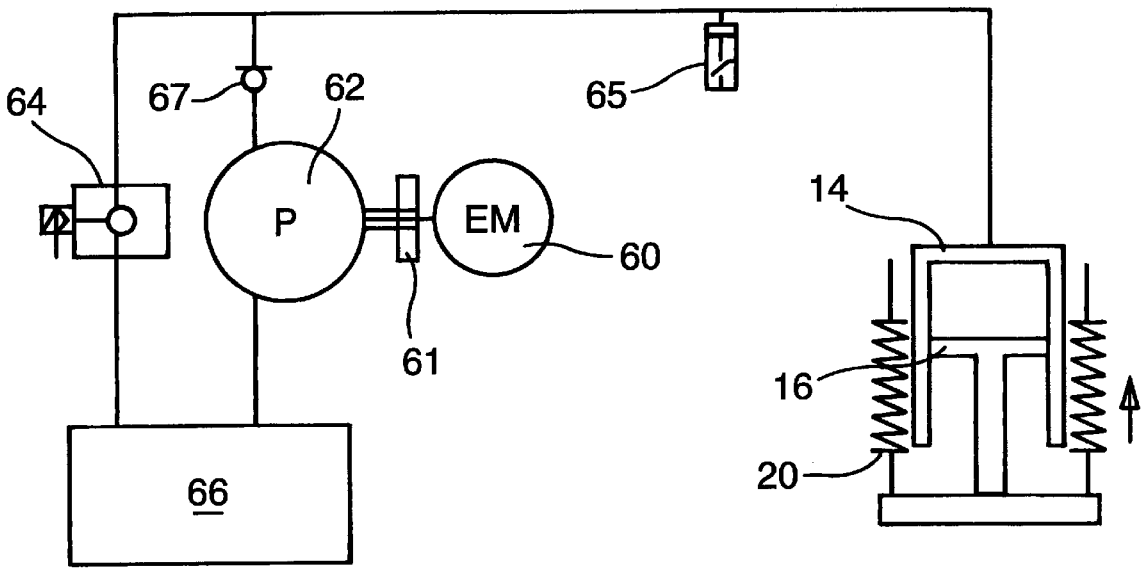
FIG. 2 is a schematic hydraulic/electrical circuit diagram of the control system for the machine of FIG. 1.

The machine shown in FIG. 1 has a frame 10 which supports a bottom press platen 12 and a hydraulic cylinder 14. The cylinder 14 has a piston 16 which moves up and down inside the cylinder and carries an upper press plate 18. The plate 18 is biased in an upward direction by springs 20 working between the plate 18 and the frame, and which retract the piston when the cylinder is not pressurized.

The plate 18 includes a heating element to heat both the plate and a die mounted on the plate, and a suitable control for allowing the user to control the temperature of the plate.

The bottom press platen supports a make-ready plate 22 on which a substrate to be embossed can be mounted when inserted into the press. The make-ready plate can be slid into and out of the gap 24 between the upper and lower platens, in the direction of the arrow 26.

In a typical unit, a user will place substrates to be embossed one at a time on the make-ready plate, and will then insert the plate into the gap 24 for embossing.

A continuous length of hot-stamping foil 28 is unwound from a feed reel 30, passed through the gap 24 and up to a draw-off reel 32. The stamping foil, as is conventional, has a carrier sheet with foil applied to the sheet. The foil passes through the gap 24 with the foil side facing downwards and the carrier side facing upwards.

On the underside of the plate 18 is a stamping die 23. This die may be plain or may have a relief pattern formed on its lower face. In use, a substrate to be foil embossed is placed on the make-ready plate, the cylinder 14 is pressurized and the upper platen is driven down which, in a known way, presses the foil against the surface of the substrate so that the foil sticks to the substrate. If the die has a relief pattern, it embosses the contours of the stamping die onto the surface (which now has foil applied to it) of the substrate. Once the embossing has been completed, the piston and upper platen retract, the foil advances through the gap and the substrate is advanced through the gap and can be taken out of the machine on the other side of the machine, as indicated at 34.

The stamping die can be mounted on a quick-change carrier which can be slid in and out of the press when a different die is to be used.

The foil path starts from the feed reel 30 which is undriven and which can rotate against a retarding friction force applied to its spindle. The foil passes over idler rollers 36, down one side of the machine, over a further idler roller 38 where the foil makes a 90° turn, through the gap 24, over an idler roller 40 where the foil makes another 90° turn and back up the other side of the machine to a draw-off reel assembly indicated generally at 42.

Figure 3:
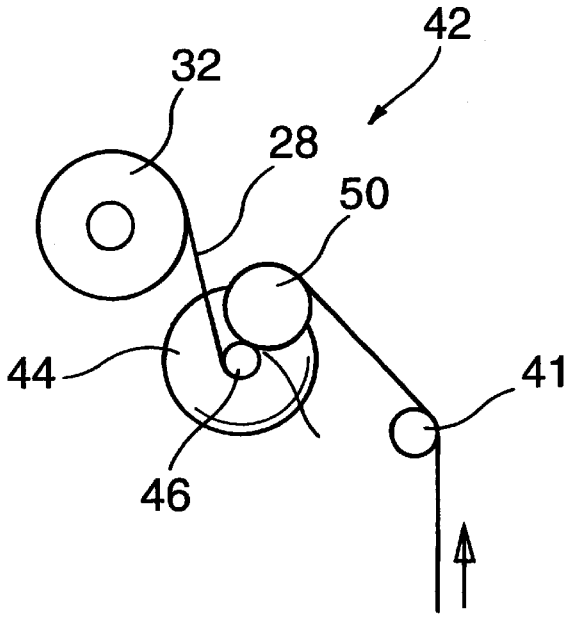
FIG. 3 shows a foil take-up roller arrangement for use in the machine of FIG. 1.

The draw-off assembly 42 is shown in more detail in FIG. 3. The foil feed through the machine is entirely governed by a stepper motor 44 which drives a small diameter roller 46 with a friction coating (for example a rubber coating). The foil passes through a nip 48 between the driven roller 46 and an idler roller 50 of relatively large diameter. The idler roller is mounted on a swing arm, and is biased towards the driven roller 46. The tension in the foil which surrounds the idler roller 50 also tends to pull the rollers 46 and 50 towards one another to increase the friction in the nip. The take-up reel 32 is driven through a slipping belt drive from the stepper motor 44. An idler roller 41 feeds the foil to the roller 50 in the correct angular orientation.

The foil feed and the hydraulic cylinder are operated in the following manner.

The machine can be left switched on, with the plate 18 held at an elevated temperature, ready for intermittent operation, for any length of time. Alternatively the press can be switched off and set to warm up for a certain period after being switched on, before performing a press cycle.

The operator will prepare the document to be embossed and position this on the make-ready plate 22. Assuming all the operating parameters have been set for that type of document (these parameters will be discussed later), the operator will push the plate 22 with the substrate into the machine and operate a switch to start a cycle.

A motor 60 with a flywheel 61 drives a hydraulic pump 62. The motor starts to drive the pump which pressurizes the cylinder 14 via a one-way check valve 67. A pressure sensor 65 in the hydraulic circuit monitors the rise in pressure and produces a signal when the die contacts the substrate and a preset pressure is reached. This preset pressure will be substantially below the maximum pressure that the cylinder must develop to complete the embossing.

When this signal is received by a control circuit controlling the current to the motor 60, a timer is started. This timer counts for a preset time and then switches off current to the motor. The motor will continue to run under the inertia of its rotor and the flywheel for a short while, until the back pressure overcomes the inertia and the motor and the pump come to a stop. The check valve 67 holds the pressure in the system and prevents the pressure from driving the motor backwards.

In a simpler version, it is possible for the pressure signal to immediately switch off current to the motor, without an intermediate timed stage. It is also possible for the motor to be switched off after a preset time, the time being determined by experiment as being the time required to build up a particular pressure in the hydraulic system.

The inertia of the flywheel and motor will result in the pump continuing to operate until the pump stalls against the pressure built up in the system.

The pressure will be held at the final level for a certain time (which may be preset by a timer), after which a dump valve 64 in the hydraulic circuit will be opened, to dump the pressure back to the fluid tank 66. The return springs 20 will then lift the piston 16. When the piston has lifted, the foil circuit motor 44 will be operated to advance the foil and to eject the substrate in the direction of the arrow 34.

At this stage, the foil will not have been separated from its carrier sheet, so advancing the foil web will carry the substrate in the direction of the arrow 34 by a distance preset to be equal to the width of the foiling die.

The foil may be removed from the substrate by separation means (not shown), for example a knife, a metal bar, or an air knife, which is moved across the surface of the substrate. For smaller presses, a knife operated by a solenoid, with a spring-biased return, is preferred. For larger presses, a motorized metal bar may be used. The separation means will be operated unless multiple impressions across the sheet are required.

If a large proportion of the area of the substrate is to be foiled, for example by applying multiple impressions on one sheet, the separation means will not be operated, and the substrate will be advanced in the direction of the arrow 34 sufficiently far so that when the web turns through 90° about the roller 40, the carrier sheet will separate from the foil which will remain on the substrate. No special measures therefore need to be taken to effect this separation.

The reservoir 66 for the hydraulic circuit can be formed by a chamber or chambers within the lower press platen 12, or by a separate chamber. In order to deaerate the returning fluid, this may be delivered into one chamber in the reservoir, and the fluid may be pumped out from a different chamber, with the fluid having to pass through a gallery below fluid level in passing from the first chamber to the different chamber, so that any entrained air remains in the first chamber (which can be fitted with a vent pipe). The motor 60 and the pump 62 can be contained in the reservoir, with the heat capacity of the hydraulic fluid in the reservoir being used to cool the motor.

The user can select, from a front panel, a number of parameters associated with the process. For example, some or all of the following parameters can be set:

the press dwell time.

the advance distance (in the direction of travel of the foil) of the die through which the foil will advance. This will depend on the corresponding dimension of the die.

the pressure to be applied by the press.

the temperature of the die.

the number of repeat impressions on each sheet.

It must be recognised that this press could be used for embossing only or for foiling only. Indeed the press could also be used for other purposes unconnected with the printing trade, and for applying pressing forces to workpieces other than documents.

Although the invention has, by way of example, been described with reference to a stamping press in which the bottom press platen is fixed and the upper press plate moves, it is to be understood that the invention is not limited to this embodiment. The upper plate could equally well be fixed and the lower plate could be movable, or both plates could be movable.

What is claimed is:

1. A method of operating a stamping press which has a pair of plates defining a press gap between them, and a hydraulic ram to provide relative movement between the plates to close the press gap and apply pressure to a die to press the die against a substrate in the gap, wherein the hydraulic ram is fed with hydraulic fluid from a pump driven by an electric motor, the method comprising the steps of driving the motor to pressurize the hydraulic ram to a pressure below a maximum pressure to be achieved, shutting off electric current to the motor and allowing the motor to continue to run under its own inertia until it stalls to pressurize the hydraulic ram to a higher pressure, and opening a dump valve to dump the pressure after a predetermined time period after the motor stalls.

2. A method as claimed in claim 1, wherein the motor is shut off in response to attainment of a specific predetermined pressure in the hydraulic ram.

3. A method as claimed in claim 1, wherein the motor is shut off after a specified time which has been predetermined as corresponding to a desired pressure in the hydraulic ram.

4. A method as claimed in any preceding claim, wherein the press is operated so that when the pressure in the hydraulic ram reaches the pressure below the maximum pressure, a first timer is started and after a pre-set time period electric current to the motor is switched off.

5. A method as claimed in claim 4, wherein a second timer is used to determine when the dump valve is opened to dump the pressure.

* * * * *